US012630902B2

(12) United States Patent
Terai et al.

(10) Patent No.: US 12,630,902 B2
(45) Date of Patent: May 19, 2026

(54) HEAT-RESISTANT IR-PT ALLOY

(71) Applicants: ISHIFUKU METAL INDUSTRY CO., LTD., Tokyo (JP); DENSO CORPORATION, Kariya (JP)

(72) Inventors: Kenta Terai, Soka (JP); Shunsuke Takeya, Soka (JP); Hayato Yasuhara, Soka (JP); Akihiro Shibata, Soka (JP); Ryohei Akiyoshi, Kariya (JP); Yuji Kaji, Kariya (JP)

(73) Assignees: ISHIFUKU METAL INDUSTRY CO., LTD., Tokyo (JP); DENSO CORPORATION, Kariya (JP)

( * ) Notice: Subject to any disclaimer, the term of this patent is extended or adjusted under 35 U.S.C. 154(b) by 328 days.

(21) Appl. No.: 18/143,654

(22) Filed: May 5, 2023

(65) Prior Publication Data

US 2023/0383381 A1 Nov. 30, 2023

(30) Foreign Application Priority Data

May 25, 2022 (JP) ..... 2022-085087

(51) Int. Cl.
*C22C 5/04* (2006.01)

(52) U.S. Cl.
CPC ..... *C22C 5/04* (2013.01)

(58) Field of Classification Search
CPC ..... C22C 5/04; C22F 1/14
See application file for complete search history.

(56) References Cited

U.S. PATENT DOCUMENTS 10,137,496 B2 11/2018 Yoshikawa et al.

FOREIGN PATENT DOCUMENTS

| | | |
|---|---|---|
| JP | 2010-138418 A | 6/2010 |
| JP | 2018-059165 A | 4/2018 |
| WO | 2004/007782 A1 | 1/2004 |

OTHER PUBLICATIONS

Oct. 12, 2023 Search Opinion and Report issued in European Patent Application No. 23168930.8.

*Primary Examiner* — Jessee R Roe
(74) *Attorney, Agent, or Firm* — Oliff PLC

(57) ABSTRACT

Provided is a heat-resistant Ir alloy, which is further improved in Vickers hardness while maintaining satisfactory processability. Specifically, provided is a heat-resistant Ir alloy, including: 5 mass % to 30 mass % of Pt; 0.5 mass % to 5 mass % of Ta; and 0.003 mass % to 0.15 mass % of at least one kind selected from the group consisting of: Sc; Hf; and W, with the balance being Ir.

1 Claim, No Drawings

HEAT-RESISTANT IR-PT ALLOY

BACKGROUND OF THE INVENTION

1. Field of the Invention

The present invention relates to a heat-resistant Ir alloy to be used for a crucible for high temperature, a heat-resistant device, a gas turbine, a spark plug, a sensor for high temperature, a jet engine, and the like.

2. Description of the Related Art

Various alloys have been developed as heat-resistant materials to be used for a crucible for high temperature, a heat-resistant device, a gas turbine, a spark plug, a sensor for high temperature, a jet engine, and the like. As major heat-resistant materials, there are given, for example, heat-resistant steel, a nickel-based superalloy, a platinum alloy, and tungsten. The heat-resistant steel, the nickel-based superalloy, the platinum alloy, and the like have solidus points of less than 2,000° C., and hence cannot be used at a temperature of 2,000° C. or more. Meanwhile, high-melting point metals, such as tungsten and molybdenum, suffer from severe oxidation wear in the air at high temperature. In view of the foregoing, an Ir alloy has been developed as a heat-resistant material having a high melting point and having high oxidation wear resistance.

In Japanese Patent Application Laid-open No. 2010-138418, there is a description that when a predetermined amount of platinum and a predetermined amount of an alkaline earth metal element are incorporated in an iridium alloy, the Ir alloy can be used stably under a high-temperature environment over a long time period.

It is demanded that the Ir alloy to be used as the heat-resistant material can be used stably over a long time period. For example, for use in a gas turbine, the Ir alloy is required to have such mechanical strength that the alloy can withstand a centrifugal force of the turbine. Accordingly, there is an issue that the Ir alloy needs to be further improved in hardness.

SUMMARY OF THE INVENTION

In view of the foregoing, an object of the present invention is to provide a heat-resistant Ir alloy, which is further improved in Vickers hardness while maintaining satisfactory processability.

The inventors of the present invention have found that the hardness of an Ir—Pt alloy is increased by adding Ta and any one or more of Sc, Hf, and W in a slight amount. Thus, the inventors have arrived at the present invention.

According to at least one embodiment of the present invention, there is provided a heat-resistant Ir alloy, including: 5 mass % to 30 mass % of Pt; 0.5 mass % to 5 mass % of Ta; and 0.003 mass % to 0.15 mass % of at least one kind selected from the group consisting of: Sc; Hf; and W, with the balance being Ir.

According to at least one embodiment of the present invention, the heat-resistant Ir alloy, which is further increased in Vickers hardness while maintaining satisfactory processability, can be provided.

DESCRIPTION OF THE EMBODIMENTS

The present invention is directed to a heat-resistant Ir alloy, including: 5 mass % to 30 mass % of Pt; 0.5 mass % to 5 mass % of Ta; and 0.003 mass % to 0.15 mass % of at least one kind selected from the group consisting of: Sc; Hf; and W. When the heat-resistant Ir alloy includes two or more kinds selected from the group consisting of: Sc; Hf; and W, the total content thereof is set to from 0.003 mass % to 0.15 mass %. The "Ir alloy" refers to an alloy including Ir as a main element. In addition, the Ir alloy according to at least one embodiment of the present invention may include inevitable impurities in addition to the above-mentioned elements.

When the Ir alloy includes 5 mass % to 30 mass % of Pt, oxidative volatilization of Ir from a crystal grain boundary is suppressed in the air at high temperature or in an oxidizing atmosphere, and the oxidation wear resistance of the alloy is remarkably improved. When the content of Pt is less than 5 mass %, the oxidation wear resistance of the Ir alloy is insufficient. Meanwhile, when the content of Pt is more than 30 mass %, while the oxidation wear resistance of the Ir alloy becomes satisfactory, the upper limit of a temperature range in which the Ir alloy can maintain its strength is reduced owing to a reduction in recrystallization temperature.

When an Ir—Pt alloy includes 0.5 mass % to 5 mass % of Ta, the hardness of the alloy is increased through solid solution hardening due to Ta. The content of Ta is preferably 0.7 mass % or more. When the content of Ta is less than 0.5 mass %, the solid solution hardening is insufficient. Meanwhile, when the content of Ta is more than 5 mass %, it becomes difficult to process the alloy owing to a reduction in plastic deformability.

When an Ir—Pt—Ta alloy includes 0.003 mass % to 0.15 mass % of at least one kind selected from the group consisting of: Sc; Hf; and W, the hardness of the alloy is increased through solid solution hardening and/or finer crystal grains. Sc and Hf, which each have a lower melting point than the Ir—Pt—Ta alloy, are preferentially solid-soluted in a grain boundary at a final solidification portion of the alloy, to thereby suitably strengthen a fragile crystal grain boundary of the Ir alloy. W, which has a higher melting point than the Ir—Pt—Ta alloy, serves as a nucleation site at the time of solidification, to thereby make a solidified structure of the Ir—Pt—Ta alloy finer.

The content of the at least one kind selected from the group consisting of: Sc; Hf; and W (when two or more kinds thereof are included, a total thereof) is preferably 0.005 mass % or more. The content of the at least one kind selected from the group consisting of: Sc; Hf; and W (when two or more kinds thereof are included, a total thereof) is more preferably 0.01 mass % or more. When the content of the at least one kind selected from the group consisting of: Sc; Hf; and W (when two or more kinds thereof are included, a total thereof) is more than 0.15 mass %, the hardness of the alloy is improved, but the processability thereof is reduced.

The Vickers hardness of the heat-resistant Ir alloy according to at least one embodiment of the present invention is 600 HV or more.

Each of the above-mentioned alloys is formed of a single-phase solid solution which is free of a second phase. Accordingly, each of the alloys has satisfactory ductility, can be plastically formed into various shapes and dimensions through known warm working or hot working, and is also easily mechanically processed and welded.

EXAMPLES

Examples of the present invention are described. First, raw material powders (Ir powder, Pt powder, Ta powder, Sc powder, Hf powder, and W powder) were mixed at a predetermined ratio to produce mixed powder. Next, the resultant mixed powder was molded with a uniaxial pressing machine to provide a green compact. The resultant green compact was melted by an arc melting method to produce an ingot.

Next, the ingot thus produced was subjected to hot forging to provide a square bar having a width of 15 mm. The square bar was subjected to hot groove rolling and wire drawing die processing to provide a wire rod of φ0.5 mm.

The hardness of a longitudinal cross section of the wire rod having been cut into a predetermined length was measured under the conditions of a load of 200 gf and a retention time of 10 seconds with a micro Vickers hardness tester.

The processability was evaluated through the above-mentioned step of processing the ingot into the wire rod. In Table 1, a case in which a wire rod of φ0.5 mm was obtained was indicated by Symbol "○", and a case in which the wire rod of φ0.5 mm was not obtained was indicated by Symbol "x".

The compositions and test results of the alloys of Examples and Comparative Examples are shown in Table 1.

TABLE 1

| | | Composition (mass %) | | | | | | | Hardness |
|---|---|---|---|---|---|---|---|---|---|
| | Number | Ir | Pt | Ta | Sc | Hf | W | Processability | HV |
| Example | 1 | Balance | 5 | 1 | 0.075 | — | — | ○ | 648 |
| | 2 | Balance | 5 | 1 | — | — | 0.075 | ○ | 605 |
| | 3 | Balance | 5 | 3 | 0.075 | — | — | ○ | 693 |
| | 4 | Balance | 5 | 3 | — | 0.075 | — | ○ | 716 |
| | 5 | Balance | 10 | 3 | 0.15 | — | — | ○ | 697 |
| | 6 | Balance | 10 | 3 | — | 0.005 | — | ○ | 661 |
| | 7 | Balance | 10 | 3 | — | 0.15 | — | ○ | 721 |
| | 8 | Balance | 10 | 3 | — | — | 0.15 | ○ | 678 |
| | 9 | Balance | 10 | 3 | 0.05 | 0.05 | 0.05 | ○ | 703 |
| | 10 | Balance | 10 | 5 | — | 0.05 | — | ○ | 743 |
| | 11 | Balance | 10 | 5 | — | — | 0.05 | ○ | 710 |
| | 12 | Balance | 20 | 1 | — | 0.10 | — | ○ | 632 |
| | 13 | Balance | 20 | 1 | — | — | 0.10 | ○ | 617 |
| | 14 | Balance | 30 | 1 | 0.005 | — | — | ○ | 643 |
| | 15 | Balance | 30 | 1 | — | — | 0.005 | ○ | 635 |
| Comparative Example | 1 | Balance | 5 | — | — | — | — | ○ | 473 |
| | 2 | Balance | 5 | 1 | — | — | — | ○ | 523 |
| | 3 | Balance | 10 | 3 | 0.20 | — | — | x | — |
| | 4 | Balance | 10 | 3 | — | 0.20 | — | x | — |

The alloys of Examples 1 to 15 are each an alloy in which Ta and at least one kind selected from the group consisting of: Sc; Hf; and W are added to Ir—Pt. The alloys of Examples 1 to 15 are increased in hardness as compared to those of Comparative Examples 1 and 2, in each of which Sc, Hf, and W are not added. Meanwhile, the alloys of Comparative Examples 3 and 4, in each of which Sc or Hf is added in an amount of 0.20 mass %, are remarkably reduced in processability.

It was able to be recognized that the alloys of Examples each had a hardness of 600 HV or more and processability indicated by Symbol "○", and thus achieved both a high hardness and satisfactory processability, and had excellent characteristics as a heat-resistant Ir alloy.

What is claimed is:

1. A heat-resistant Ir alloy, comprising:

5 mass % to 30 mass % of Pt;

0.5 mass % to 5 mass % of Ta; and 0.003 mass % to 0.15 mass % of at least one kind selected from the group consisting of: Sc and Hf, with the balance being Ir and inevitable impurities.

* * * * *